US009296529B2

(12) United States Patent
Malaviya

(10) Patent No.: US 9,296,529 B2
(45) Date of Patent: Mar. 29, 2016

(54) BEVERAGE CANISTER TOP

(71) Applicant: Lalkrushna C. Malaviya, Philadelphia, PA (US)

(72) Inventor: Lalkrushna C. Malaviya, Philadelphia, PA (US)

( * ) Notice: Subject to any disclaimer, the term of this patent is extended or adjusted under 35 U.S.C. 154(b) by 41 days.

(21) Appl. No.: 14/017,017

(22) Filed: Sep. 3, 2013

(65) Prior Publication Data

US 2014/0069924 A1 Mar. 13, 2014

Related U.S. Application Data

(60) Provisional application No. 61/699,549, filed on Sep. 11, 2012.

(51) Int. Cl.

| | |
|---|---|
| ***B65D 17/32*** | (2006.01) |
| ***B65D 17/34*** | (2006.01) |
| ***B65D 47/10*** | (2006.01) |
| ***B65D 17/00*** | (2006.01) |
| *B65D 17/30* | (2006.01) |

(52) U.S. Cl.

CPC ..... *B65D 47/106* (2013.01); *B65D 17/165* (2013.01); *B65D 2205/02* (2013.01); *B65D 2517/0014* (2013.01); *B65D 2517/0094* (2013.01)

(58) Field of Classification Search

CPC ..... B65D 17/165; B65D 17/163; B65D 2517/0014; B65D 2517/0077; B65D 2517/0079; B65D 2517/0089; B65D 2517/0049; B65D 2517/0092; B65D 2517/0094

USPC ..... 220/272, 267, 271, 277, 273

See application file for complete search history.

(56) References Cited

U.S. PATENT DOCUMENTS

| | | | | |
|---|---|---|---|---|
| 8,245,866 | B2 * | 8/2012 | Gibson et al. | 220/269 |
| 8,573,432 | B2 * | 11/2013 | Emanuele et al. | 220/271 |
| 2010/0018976 | A1 * | 1/2010 | Christian et al. | 220/268 |
| 2010/0294771 | A1 * | 11/2010 | Holder et al. | 220/271 |
| 2011/0056946 | A1 * | 3/2011 | Emanuele et al. | 220/271 |
| 2011/0266281 | A1 * | 11/2011 | Thiemann et al. | 220/271 |
| 2012/0048870 | A1 * | 3/2012 | Ellerbe et al. | 220/712 |
| 2012/0260613 | A1 * | 10/2012 | Holder et al. | 53/492 |
| 2013/0037543 | A1 * | 2/2013 | McClung et al. | 220/269 |

* cited by examiner

*Primary Examiner* — Mickey Yu
*Assistant Examiner* — Niki Eloshway

(57) ABSTRACT

A beverage canister top that facilitates high flow rate includes a canister base, a lateral wall, and a canister top. The canister base and the canister top are oppositely positioned from each other, and the lateral wall is positioned in between the canister top and the canister base. The positioning of the canister base, the lateral wall, and canister top complete the beverage canister. A rotatably connected opening tab of the canister top opens a main spout of the canister top so that the beverage within the beverage canister can flow out. A punch hole of the canister top which is either opened or created by a punch protrusion of the opening tab equalize the inside and outside pressure of the beverage canister in such way that the equalization of the pressure increases the beverage flow rate of the beverage canister.

12 Claims, 12 Drawing Sheets

BEVERAGE CANISTER TOP

The current application claims a priority to the U.S. Provisional Patent application Ser. No. 61/699,549 filed on Sep. 11, 2012.

FIELD OF THE INVENTION

The present invention relates generally to beverage canisters. More specifically the present invention is a beverage canister top that allows the user to punch a secondary hole in the top of the can that prevents pressure differential and facilitates high flow rate of the liquid out of the beverage canister.

BACKGROUND OF THE INVENTION

Throughout history humans have sought to create better containers for holding a wide range of beverages. These containers are designed to both preserve the freshness and taste of a beverage and increase the portability of the beverage. For example, carbonated soda beverages, when first developed, were only found in soda shops where all the necessary equipment such as soda water dispensers and syrup dispensers were found. The most important factor of maintaining a carbonated soda beverage in a container is to keep both freshness of the mixed ingredients as well as ensuring the pressure resulting from the carbonation of the fluid does not escape and cause the beverage to become flat. To solve this problem and allow people to carry carbonated soda beverages with them, glass bottles were introduced. However glass bottles suffered from a number of drawbacks such as high weight and risk of breakage. Glass soda bottles are still used to this day as some people and companies value the benefits glass bottles offer over the more modern beverage containers that have come into wide use in the world today. One of the most common forms of beverage container used to hold pressurized beverages like soda and beer is the aluminum can. Aluminum cans are lightweight, easy to open, and recyclable as well as avoiding the possibility of shattering should failure of the container occur. Creating an easy to open aluminum beverage can is well known in the art and is not the purpose of the present invention. The purpose of the present invention is to integrate several new components into the existing structure of an aluminum can to provide additional functionality to the can. One of the major drawbacks of the aluminum can is the fact the liquid contained within cannot all be drank from the can without removing ones mouth from the can or crushing the can to equalize pressure. Turbulence caused by the current one hole design also leads to loss of some of the carbonation of the carbonated drink. The traditional way of solving this problem is to poke another hole somewhere in the can to allow air to flow into the can while the carbonated beverage flows out of the can and into the consumer's mouth. This is most commonly done with a car key; however this method lacks the ease and convenience that are associated with simply opening an aluminum beverage can. Some prior art have solved this problem by introducing aluminum beverage cans which have tops that are specifically designed to be punctured to allow pressure balance. Although this effectively solves the issues of pressure balance and ease of preparing the can for drinking, it requires the use of a tool which is separate from the rest of the can. Without the tool, the benefits offered by these specifically designed cans cannot be taken advantage of.

It is therefore the primary object of the present invention to create an aluminum beverage can which integrates components that allow the user to punch a hole into the top of the can.

This hole facilitates pressure balance and as such allows the liquid to flow out of the beverage can quickly and continuously.

DETAIL DESCRIPTIONS OF THE INVENTION

All illustrations of the drawings are for the purpose of describing selected versions of the present invention and are not intended to limit the scope of the present invention.

The present invention is a beverage canister top 3 which facilitates a high flow rate compare to the traditional beverage canisters. In reference to FIG. 1, the present invention comprises a canister base 1, a lateral wall 2, and a canister top 3. The canister base 1 is oppositely positioned from the canister top 3, and the lateral wall 2 is perimetrically positioned in between the canister base 1 and the canister top 3 creating the beverage canister of the present invention. Similar to the traditional beverage canisters, the present invention is able to store pressurized beverages such as carbonated soda, but the present invention increases the flow rate of the pressurized beverage when the beverage canister is opened and the pressurized beverage is poured out. The present invention is able to achieve a higher flow rate compare to the traditional beverage canisters by equalizing the inside and outside pressure of the beverage canister. All of the components of the present invention are made from light weight and high strength materials such as standard aluminum or any other type of similar materials.

Figure 1:
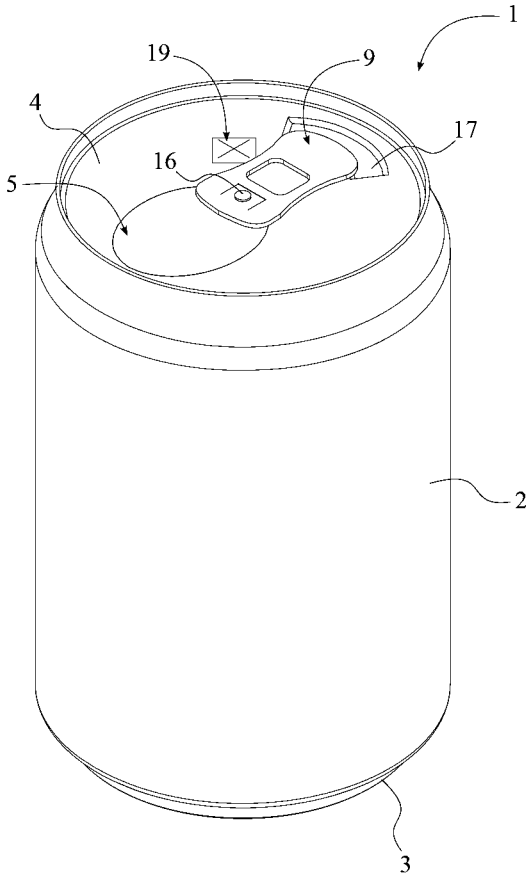
FIG. 1 is a perspective view of the preferred embodiment of the present invention.
Figure 2:
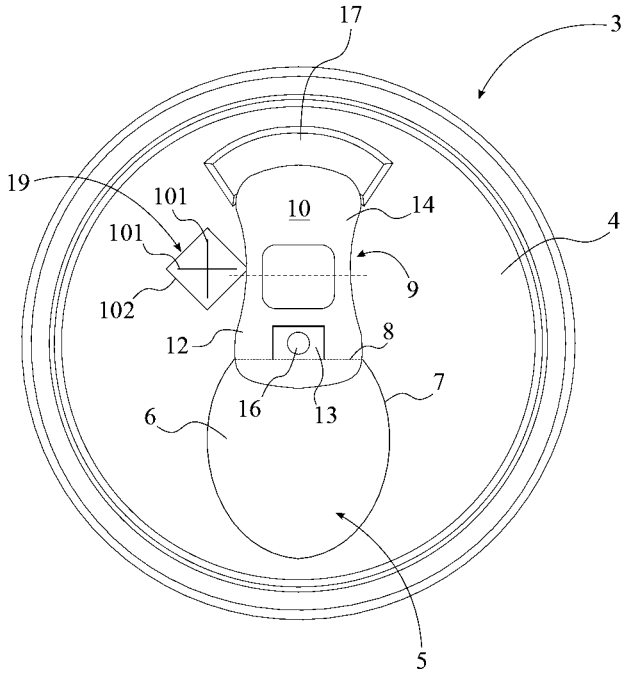
FIG. 2 is a top view of the preferred embodiment of the present invention, wherein the main spout and punch hole are in a closed position.

In reference to FIG. 1 and FIG. 2, the canister top 3 comprises a top face 4, a main spout 5, a rivet 16, an opening tab 9, at least one punch hole 19, a recessed cavity 17, and a protrusion cavity 18. The top face 4 is positioned on the canister top 3 opposite from the lateral wall 2. The top face 4 provides the necessary space for the positioning and the attachment of the main spout 5, the rivet 16, the opening tab 9, the at least one punch hole 19, the recessed cavity 17, and the protrusion cavity 18.

In reference to FIG. 1-FIG. 5, the main spout 5 is positioned on the top face 4 and comprises a spout tab 6, a grooved perimeter 7, and an ungrooved perimeter 8. The grooved perimeter 7 is positioned on the top face 4, where the grooved perimeter 7 is cut into the material of the top face 4 but not all the way through. The grooved perimeter 7 outlines the shape of the spout tab 6. The grooved perimeter 7 does not fully encircle the entire perimeter of the spout tab 6 in such way that the ungrooved perimeter 8 is positioned in between the grooved perimeter 7. More specifically, the grooved perimeter 7 and the ungrooved perimeter 8 fully encircle the spout tab 6 completing the preferable shape of the main spout 5.

Figure 3:
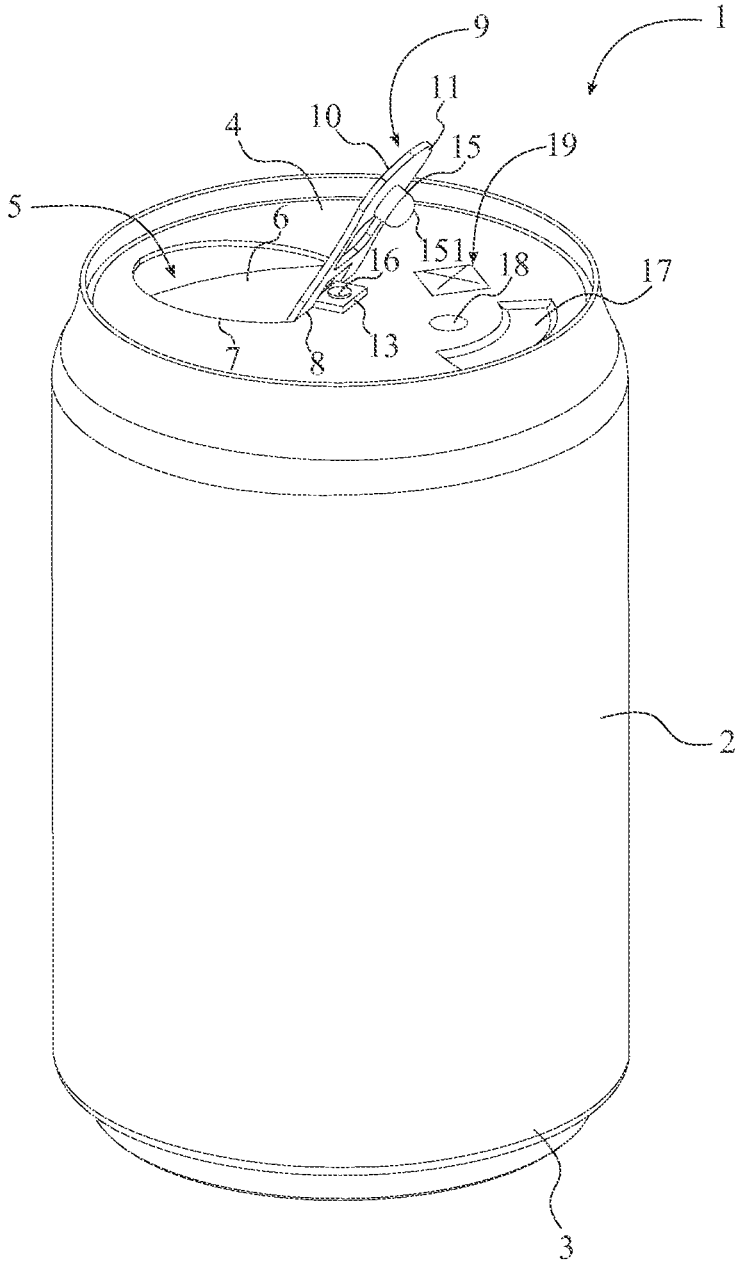
FIG. 3 is a top view of the preferred embodiment of the present invention, wherein the main spout is in an opened position.

In reference to FIG. 3, the recessed cavity 17 is positioned on the top face 4, where the recessed cavity 17 is linearly and oppositely positioned from the main spout 5. The protrusion cavity 18 is positioned on the top surface 10 in such way that the protrusion cavity 18 is positioned in between the main spout 5 and the recessed cavity 17. The opening tab 9 is positioned on the top face 4 and comprises a top surface 10, a bottom surface 11, an opening portion 12, an attachment section 13, a grip portion 14, and a punch protrusion 15. The opening portion 12 and the grip portion 14 are adjacently and oppositely positioned on the opening tab 9 where the opening portion 12 and the grip portion 14 allow the users of the present invention to open the main spout 5. The top surface 10 and the bottom surface 11 are oppositely positioned from each other on the opening tab 9 and extend over the opening portion 12 and the grip portion 14 as continuous planes. Additionally, the opening portion 12 is positioned atop the top face 4 and the main spout 5, where a bottom section of the opening portion 12 is extended over the main spout 5. The grip portion 14 is positioned atop the top face 4 and recessed cavity 17, where a top section of the grip portion 14 is extended over the recessed cavity 17. The attachment section 13 is flexibly connected with the opening portion 12. More specifically, one extremity of the attachment section 13, which is adjacently positioned with the ungrooved perimeter 8, is flexibly connected with the opening portion 12 while the other extremities of the attachment section 13 are freely positioned from the opening portion 12. The punch protrusion 15 is connected with the grip portion 14, where the punch protrusion 15 is extended out from the bottom surface 11 and perpendicularly positioned with the bottom surface 11. Even though the punch protrusion 15 is preferably positioned in the center of the grip portion 14, the punch protrusion 15 can also be positioned on the side edge of the grip portion 14.

Figure 4:
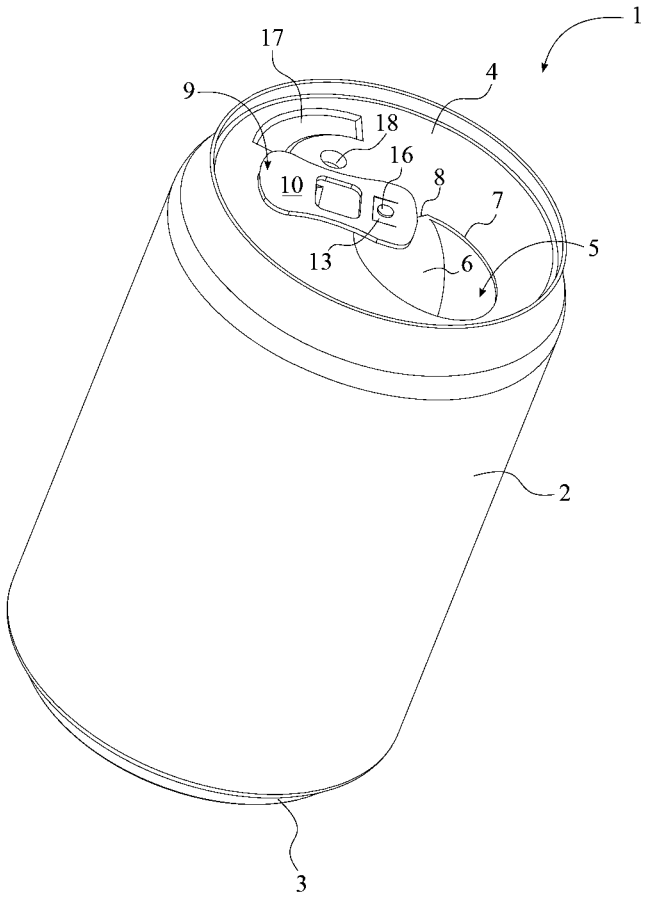
FIG. 4 is a top perspective view of the preferred embodiment of the present invention with the punch protrusion being pushed down into the punch hole.
Figure 5:
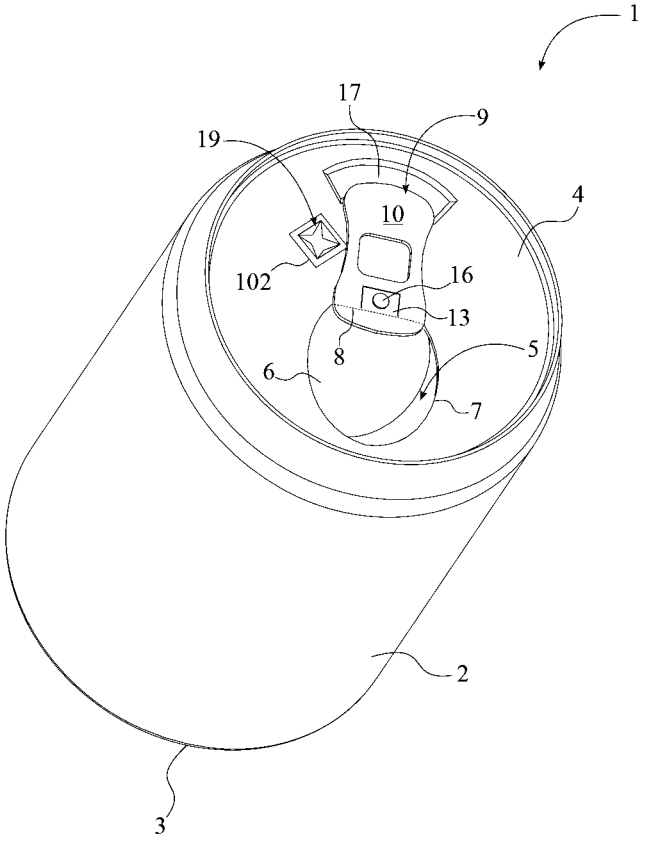
FIG. 5 is a top perspective view of the preferred embodiment of the present invention with the punch hole and main spout being opened and the opening tab being returned to the initial position.

In reference to FIG. 3, FIG. 4, and FIG. 5, the attachment section 13 is rotatably connected with the top face 4 through the rivet 16 so that the opening tab 9 can be rotated in any direction with relative the central axis of the rivet 16. The opening tab 9 is connected to the top face 4 in such way that the punch protrusion 15 is adjacently positioned within the protrusion cavity 18. This ensures that the opening tab 9 can lie flat on the top face 4 while the punch protrusion 15 is stored within the protrusion cavity 18. The recessed cavity 17 provides a negative space so that the grip portion 14 can be easily griped by the users. Once the users lift the grip portion 14, the opening portion 12 pushes the spout tab 6 downward which breaks the spout tab 6 away from the top face 4 only through the grooved perimeter 7. The ungrooved perimeter 8 holds the spout tab 6 with respect to the top face 4 so that the spout tab 6 is not completely removed from the top face 4. The ungrooved perimeter 8 ensures that no pieces are loose inside the beverage canister which could pose choking hazards to the users. The function described above allows the beverage canister to be opened, allowing the users to drink the beverage within via the main spout 5.

Figure 10:
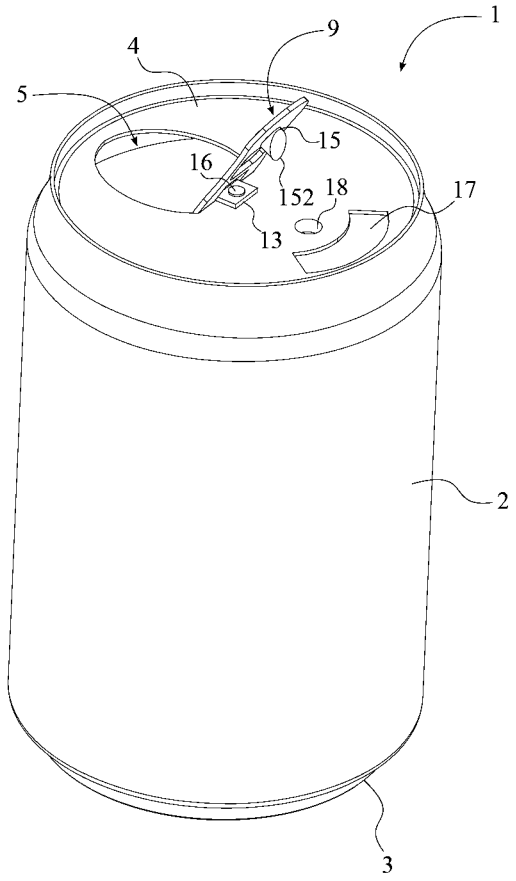
FIG. 10 is a rear perspective view of the third alternative embodiment of the present invention.

In reference to FIG. 3 and FIG. 10, depending on different embodiments, the punch protrusion 15 comprises a circular bottom edge 151 or a slanted sharp bottom edge 152, where the circular bottom edge 151 opens the at least one punch hole 19 and the slanted sharp bottom edge 152 creates the at least one punch hole 19. The at least one punch hole 19 is positioned on the top face 4 and radially positioned around the rivet 16 in such way that the at least one punch hole 19 is positioned in between the main spout 5 and the recessed cavity 17. The at least one punch hole 19 can be located on either the left side, the right side, or on both sides depending on the different embodiments of the present invention. Once the users open the main spout 5 through the opening portion 12 of the opening tab 9, the users can rotate the opening tab 9 with respect to the rivet 16 and either open or create the at least one punch hole 19 by the punch protrusion 15. Once the at least one punch hole 19 is opened or created within the top face 4, the opening tab 9 is rotated back into the initial position. Then the air is able to get into the present invention through the at least one punch hole 19 so that the inside and outside pressure of the present invention can come to an equilibrium stage. This allows the users to drink the beverage within the beverage canister with ease as the fluid flows easily and continuously as a result of the equal air pressure inside and outside the beverage canister.

As shown in FIG. 1-FIG. 5, in a preferred embodiment of the present invention, the at least one punch hole 19 comprises a pair of grooved edges 101 and an ungrooved outer edge 102. Even though the at least one punch hole 19 can be positioned anywhere in between the main spout 5 and the recessed cavity 17, the at least one punch hole 19 is preferably positioned adjacent to the grip portion 14 so that the radial distance between the punch protrusion 15 and the at least one punch hole 19 can be minimized. The ungrooved outer edge 102 is perimetrically positioned around the at least one punch hole 19, and the pair of grooved edges 101 are perpendicularly positioned with each other and positioned within the ungrooved outer edge 102. More specifically, the pair of grooved edges 101 position in X-shape so that the circular bottom edge 151 of the punch protrusion 15 is able to open the pair of grooved edges 101 while the ungrooved outer edge 102 is able to retain four open pieces of the at least one punch hole 19 with respect to the top face 4. The pair of grooved edges 101 easily sheared with the punch protrusion 15 in such way that the four open pieces are bent down into the interior volume of the beverage canister through the ungrooved outer edge 102, and no metal pieces fall into the contained liquid of the beverage canister when the at least punch hole 19 is opened. The area of the punch hole 19 can have small depression to avoid slippage while pressing the punch protrusion 15 on it. It is important to note that the at least one punch hole 19 may have any different shape of ungrooved outer edge 102 and the pair of grooved edges 101 that are conducive to allowing the at least one punch hole 19 to be opened with ease without any material breaking free from the top face 4 and falling into the liquid within the beverage canister.

Figure 6:
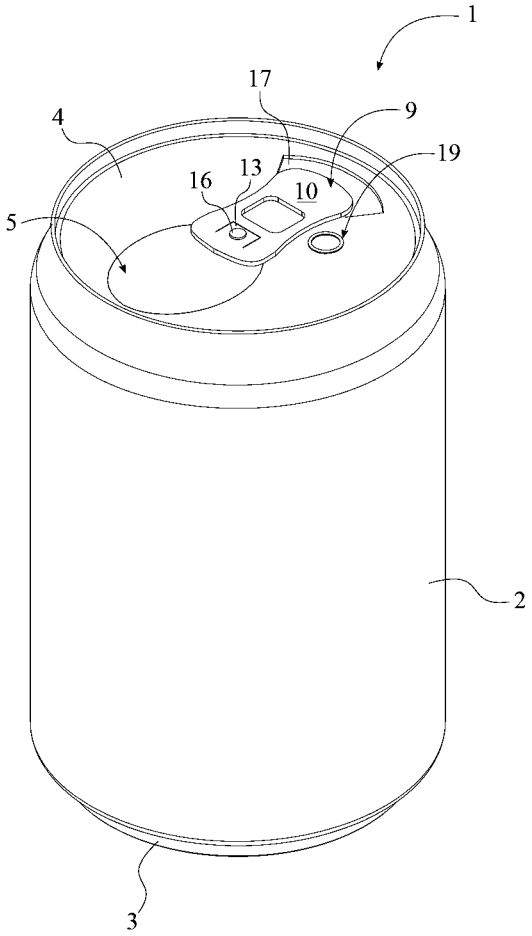
FIG. 6 is a front perspective view of the first alternative embodiment of the present invention.
Figure 7:
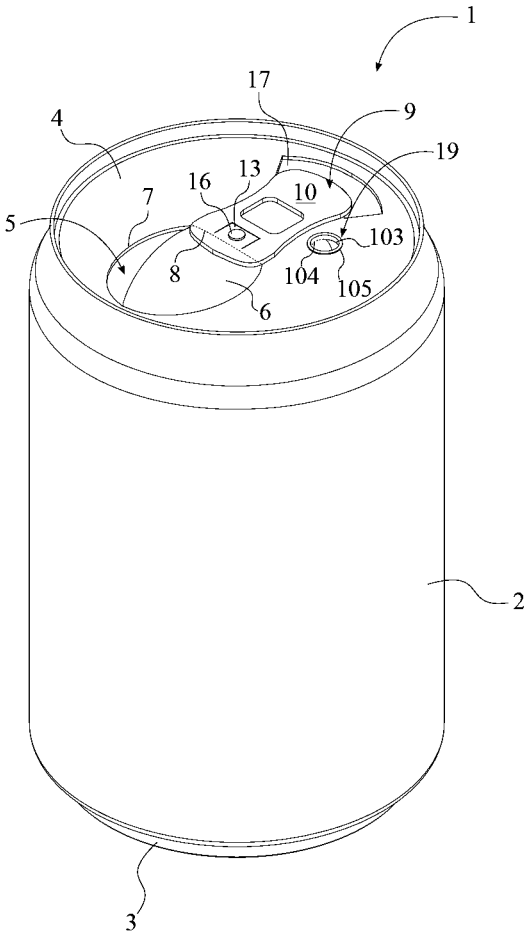
FIG. 7 is a front perspective view of the first alternative embodiment of the present invention with the main spout and punch hole being opened.

As shown in FIG. 6 and FIG. 7, in a first alternative embodiment of the present invention, the at least one punch hole 19 comprises a grooved edge 103, an ungrooved edge 104, and a rim 105. Similar to the preferred embodiment, the at least one punch hole 19 is preferably positioned adjacent to the grip portion 14 so that the radial distance between the punch protrusion 15 and the at least one punch hole 19 can be minimized. The rim 105 is perimetrically positioned around the at least one punch hole 19 so that the circular bottom edge 151 of the punch protrusion 15 is able to align with the at least one punch hole 19 within the rim 105. Additionally, the rim 105 also eliminates horizontal slippage of the punch protrusion 15 when the punch protrusion 15 is pushed down through the at least one punch hole 19. The grooved edge 103 is perimetrically positioned within the rim 105, and the ungrooved edge 104 is perimetrically positioned within the rim 105 and in between the grooved edge 103. When the punch protrusion 15 is pushed down through the at least one punch hole 19, a disk of material within the rim 105 shears away trough the grooved edge 103 and is bent down into the interior volume of the beverage canister through the ungrooved edge 104. The at least one punch hole 19 then opens a pathway for the equalization of pressure. Since the disk of material is not completely separated from the top face 4 because of the ungrooved edge 104, no choking hazards fall into the liquid contained within the beverage canister.

Figure 8:
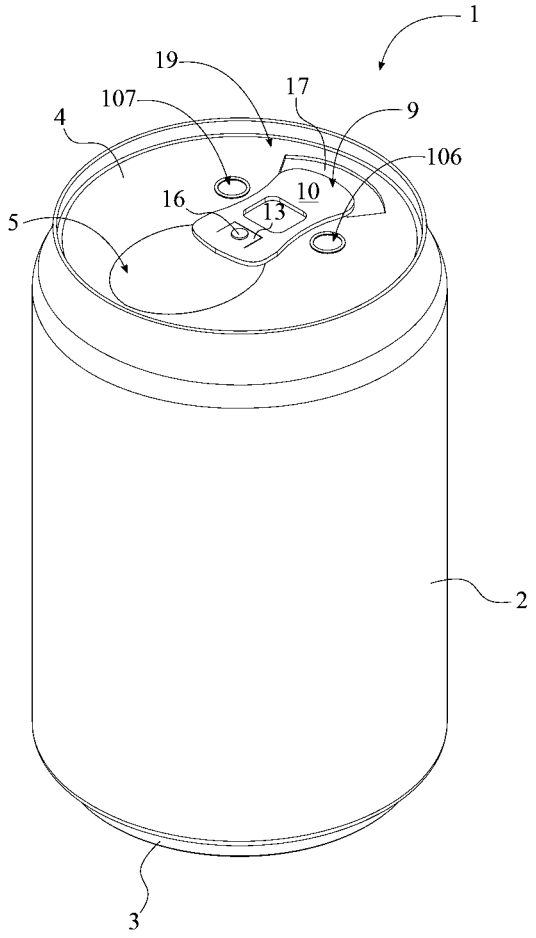
FIG. 8 is a front perspective view of the second alternative embodiment of the present invention.
Figure 9:
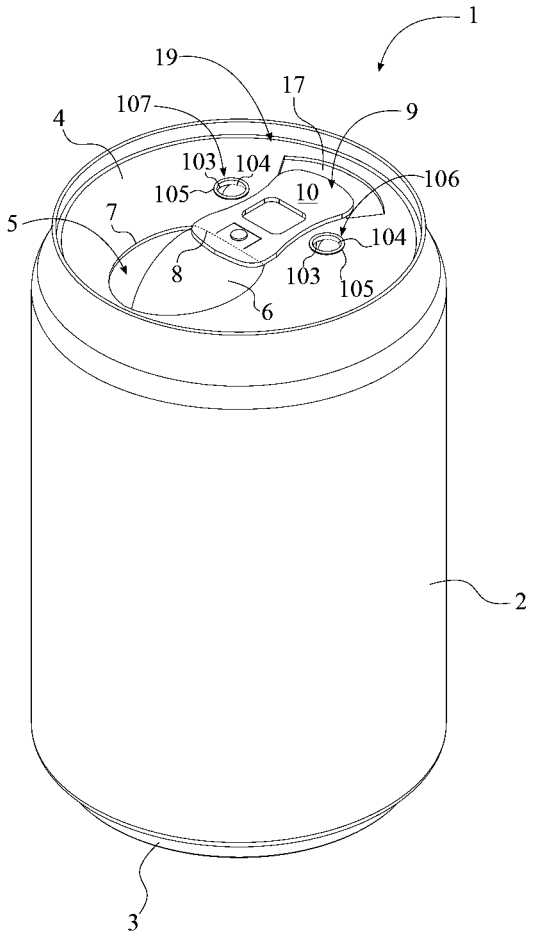
FIG. 9 is a front perspective view of the second alternative embodiment of the present invention with both punch holes and the main spout being opened.

As shown in FIG. 8 and FIG. 9, in a second alternative embodiment of the present invention, the at least one punch hole 19 comprises a first punch hole 106 and a second punch hole 107. The first punch hole 106 and the second punch hole 107 each comprise a grooved edge 103, an ungrooved edge 104, and a rim 105. Similar to the first alternative embodiment, the first punch hole 106 and the second punch hole 107 are preferably positioned adjacent to the grip portion 14 so that radial distance between the punch protrusion 15 and the both punch holes 19 can be minimized. The first punch hole 106 and the second punch hole 107 can be adjacently positioned with the grip portion 14 in such way that the both punch holes 19 are oppositely positioned from each other or adjacently positioned with each other with respect to the grip portion 14. The rim 105 is perimetrically positioned around both the first punch hole 106 and the second punch hole 107 so that the circular bottom edge 151 of the punch protrusion 15 is able to align with both the first punch hole 106 and the second punch holes 107 through the rim 105. Additionally, the rim 105 also eliminates horizontal slippage of the punch protrusion 15 when the punch protrusion 15 is pushed down through the first punch hole 106 and second punch holes 107. The grooved edge 103 of the first punch hole 106 and second punch holes 107 are perimetrically positioned within the respective rims 105, and the ungrooved edge 104 of the first punch hole 106 and second punch holes 107 are perimetrically positioned within the respective rims 105 and in between the respective grooved edges 103. Similar to the first alternative embodiment, when the punch protrusion 15 is pushed down through the first punch hole 106 and second punch holes 107 and the disks of material within the rims 105 shear away trough the grooved edges 103 and are bent down into the interior volume of the beverage canister through the ungrooved edges 104, the first punch hole 106 and second punch holes 107 open a pair of pathways for the equalization of pressure. Since the disks of material are not completely separated from the top face 4 because of the ungrooved edges 104, no choking hazards fall into the liquid contained by the beverage canister.

Figure 11:
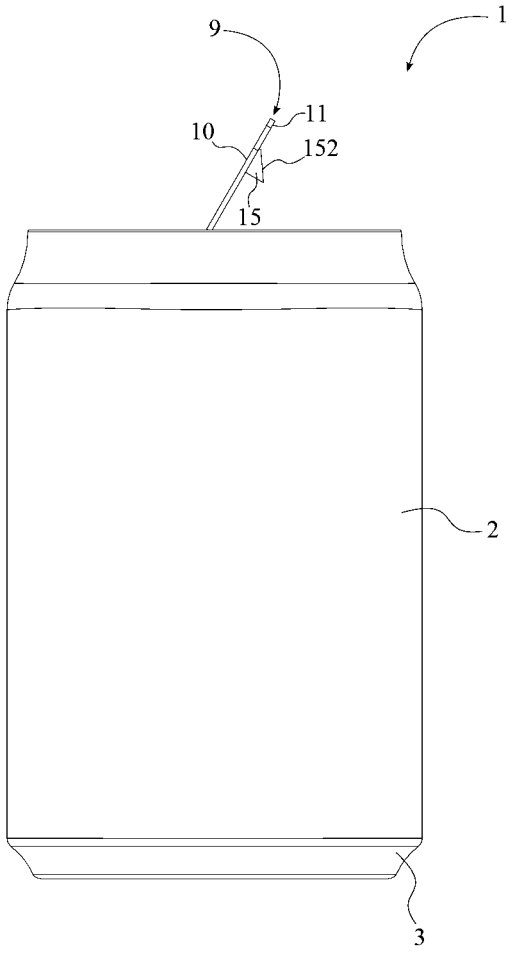
FIG. 11 is a right side view of the third alternative embodiment of the present invention.
Figure 12:
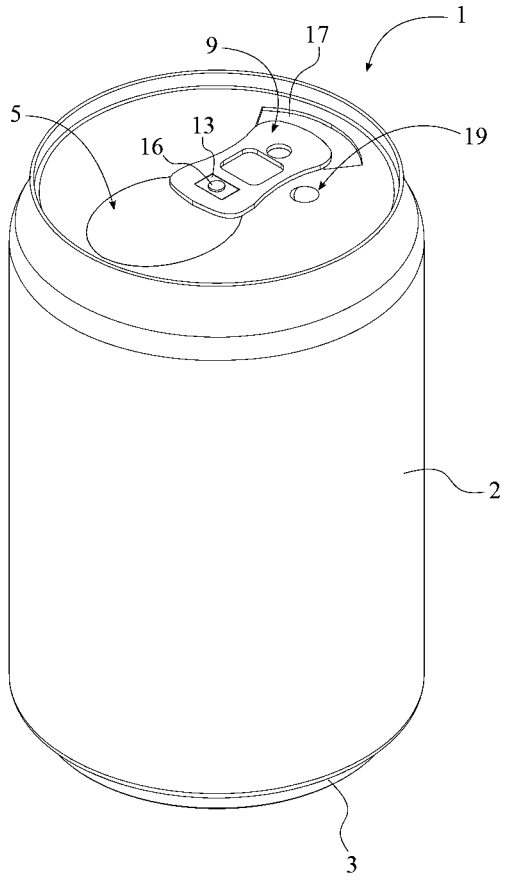
FIG. 12 is a perspective view of the third alternative embodiment of the present invention, wherein the opening tab is returned to the initial position and the punch hole is created within the top face.

As shown in FIG. 10, FIG. 11, and FIG. 12, in a third embodiment of the present invention, the at least one punch hole 19 is created by the users of the present invention by the opening tab 9. More specifically, when the slanted sharp bottom edge 152 of the punch protrusion 15 is pushed down through the top face 4, a cut section is separated by the slanted bottom edge 152 and is bent down into the interior volume of the beverage canister through an uncut section. Then the at least one punch hole 19 is created and the pathway for the equalization of pressure is opened through the at least one punch hole 19. Since the cut section is not completely separated from the top surface 10 due to the uncut section, no choking hazards fall into the liquid contained by the beverage canister. Even though the third embodiment is described with one punch hole 19, the number of punch holes 19 created within the top face 4 is not limited to one punch hole 19 and can be any other number punch holes 19 as long as the top face 4 provides sufficient surface area.

As shown in FIG. 12, in an alternative configuration of the first, second, and third alternative embodiments, the opening tab 9 can optionally comprises a protrusion dip. The protrusion dip is positioned on the grip portion 14, where the materials within the opening tab 9 is pressed to create the punch protrusion 15 during the manufactured phase of the present invention. Since the punch protrusion 15 is supposed to position within the protrusion cavity 18, the protrusion dip and the protrusion cavity 18 are formed into similar shapes, where the shape of the protrusion dip and the protrusion cavity 18 can be any geometric or organic shapes.

In another alternative configuration of the first, second, and third alternative embodiments, the punch protrusion 15 of the opening tab 9 is perimetrically positioned adjacent with the top section of the grip portion 14. In this configuration, the protrusion cavity 18 and the recessed cavity 17 are combined into a single cavity as the punch protrusion 15 positions within the single cavity when the opening tab 9 is at its initial position. The single cavity also provides enough space for the users so that the users can place their fingers on the bottom surface 11 in order to lift the grip portion 14. The punch protrusion 15 can also be placed closer to the side edge of the grip portion 14 to minimize the radial distance between the punch protrusion 15 and the at least one punch hole 19.

Although the invention has been explained in relation to its preferred embodiment, it is to be understood that many other possible modifications and variations can be made without departing from the spirit and scope of the invention as hereinafter claimed.

What is claimed is:

1. A beverage canister to facilitate high flow rate, said beverage canister comprising:

a canister base;

a lateral wall;

a canister top;

the canister top comprises a top face, a main spout, a rivet, an opening tab, at least one punch hole, a recessed cavity, and a protrusion cavity;

the main spout comprises a spout tab, a grooved perimeter, and an ungrooved perimeter;

the opening tab comprises a top surface, a bottom surface, an opening portion, an attachment section, a grip portion, and a punch protrusion;

the canister base and the canister top being oppositely positioned from each other;

the lateral wall being perimetrically positioned in between the canister base and the canister top;

the top face being positioned on the canister top opposite from the lateral wall;

the recessed cavity being positioned on the top face;

the recessed cavity being linearly and oppositely positioned from the main spout;

the protrusion cavity being positioned on the top face;

the protrusion cavity being positioned in between main spout and the recessed cavity;

the at least one punch hole being positioned on the top face;

the at least one punch hole being radially positioned next to the rivet and positioned in between the main spout and the recessed cavity;

the at least one punch hole comprises a pair of grooved edges and an ungrooved outer edge;

the at least one punch hole being adjacently positioned with the grip portion;

the ungrooved outer edge being perimetrically positioned around the at least one punch hole; and the pair of grooved edges being perpendicularly positioned with each other and within the ungrooved outer edge.

2. The beverage canister to facilitate high flow rate as claimed in claim 1, further comprising:

the main spout being positioned on the top face;

the grooved perimeter being positioned on the top face;

the ungrooved perimeter being positioned on the top face and in between the grooved perimeter; and the spout tab being positioned within the grooved perimeter and the ungrooved perimeter.

3. The beverage canister to facilitate high flow rate as claimed in claim 1, further comprising:

the opening tab being positioned on the top face;

the opening portion and the grip portion being adjacently and oppositely positioned on the opening tab;

the top surface and the bottom surface being oppositely positioned from each other on the opening tab;

the top surface and the bottom surface being extended over the opening portion and the grip portion;

the attachment section being flexibly connected with the opening portion;

the punch protrusion being connected with the grip portion; and the punch protrusion being extended out from the bottom surface and perpendicularly positioned with the bottom surface.

4. The beverage canister to facilitate high flow rate as claimed in claim 1, further comprising:

the attachment section being rotatably connected with the top face through the rivet;

the opening portion being extended over the main spout;

the opening portion being positioned atop the top face and the main spout;

the grip portion being extended over the recessed cavity;

the grip portion being positioned atop the top face and the recessed cavity;

the punch protrusion being adjacently positioned within the protrusion cavity; and the attachment section being adjacently positioned with the ungrooved perimeter.

5. The beverage canister to facilitate high flow rate as claimed in claim 4, further comprising:

wherein the punch protrusion comprises a circular bottom edge that opens the at least one punch hole.

6. The beverage canister to facilitate high flow rate as claimed in claim 1, further comprising:

the at least one punch hole comprises a rim;

the at least one punch hole being adjacently positioned with the grip portion;

the rim being perimetrically positioned around the at least one punch hole;

said pair of grooved edges being perimetrically positioned within the rim; and the ungrooved edge being perimetrically positioned within the rim and in between said pair of grooved edges.

7. A beverage canister to facilitate high flow rate, said beverage canister comprising:

a canister base;

a lateral wall;

a canister top;

the canister top comprises a top face, a main spout, a rivet, an opening tab, at least one punch hole, a recessed cavity, and a protrusion cavity;

the main spout comprises a spout tab, a grooved perimeter, and an ungrooved perimeter;

the opening tab comprises a top surface, a bottom surface, an opening portion, an attachment section, a grip portion, and a punch protrusion;

the at least one punch hole being positioned on the top face;

the at least one punch hole being radially positioned next to the rivet and positioned in between the main spout and the recessed cavity;

the opening tab being positioned on the top face;

the opening portion and the grip portion being adjacently and oppositely positioned on the opening tab;

the top surface and the bottom surface being oppositely positioned from each other on the opening tab;

the top surface and the bottom surface being extended over the opening portion and the grip portion;

the attachment section being flexibly connected with the opening portion;

the punch protrusion being connected with the grip portion;

the punch protrusion being extended out from the bottom surface and perpendicularly positioned with the bottom surface;

the main spout being positioned on the top face;

the grooved perimeter being positioned on the top face;

the ungrooved perimeter being positioned on the top face and in between the grooved perimeter; and the spout tab being positioned within the grooved perimeter and the ungrooved perimeter.

8. The beverage canister facilitate high flow rate as claimed in claim 7, further comprising:

the canister base and the canister top being oppositely positioned from each other;

the lateral wall being perimetrically positioned in between the canister base and the canister top; and the top face being positioned on the canister top opposite from the lateral wall.

9. The beverage canister to facilitate high flow rate as claimed in claim 7, further comprising:

the recessed cavity being positioned on the top face; and the recessed cavity being linearly and oppositely positioned from the main spout.

10. The beverage canister to facilitate high flow rate as claimed in claim 7, further comprising:

the protrusion cavity being positioned on the top face; and the protrusion cavity being positioned in between main spout and the recessed cavity.

11. The beverage canister to facilitate high flow rate as claimed in claim 7, further comprising:

the attachment section being rotatably connected with the top face through the rivet;

the opening portion being extended over the main spout;

the opening portion being positioned atop the top face and the main spout;

the grip portion being extended over the recessed cavity;

the grip portion being positioned atop the top face and the recessed cavity;

the punch protrusion being adjacently positioned within the protrusion cavity; and the attachment section being adjacently positioned with the grooved perimeter.

12. The beverage canister to facilitate high flow rate as claimed in claim 11, further comprising:

wherein the punch protrusion comprises a slanted sharp bottom edge that creates the at least one punch hole through the top face.

* * * * *